US005441506A

United States Patent [19]

Gabion et al.

[11] Patent Number: 5,441,506

[45] Date of Patent: Aug. 15, 1995

[54] EPILATING APPLIANCE WITH GRIPPING FORCE ADJUSTMENT MEANS

[75] Inventors: Georges Gabion; Aimé Clevet; Robert Roger, all of Lyons, France

[73] Assignee: Braun Aktiengesellschaft, Frankfurt, Germany

[21] Appl. No.: 196,187

[22] PCT Filed: Aug. 27, 1992

[86] PCT No.: PCT/DE92/01974

§ 371 Date: Feb. 23, 1994

§ 102(e) Date: Feb. 23, 1994

[87] PCT Pub. No.: WO93/04608

PCT Pub. Date: Mar. 18, 1993

[30] Foreign Application Priority Data

Aug. 28, 1991 [FR] France ..... 91 10696

[51] Int. Cl.[6] ..... A45D 26/00

[52] U.S. Cl. ..... 606/133; 606/131

[58] Field of Search ..... 606/1, 131, 133; 452/82, 83, 102, 99

[56] References Cited

U.S. PATENT DOCUMENTS 1,923,415 8/1933 Bingham ..... 452/82

5,207,689 5/1993 Demeester ..... 606/133

FOREIGN PATENT DOCUMENTS 0403315 12/1990 European Pat. Off. .

0532106 3/1993 European Pat. Off. ..... 606/133

1032138 2/1951 France .

2678822 1/1993 France ..... 606/133

2686001 7/1993 France ..... 606/133

0328426B1 8/1989 Germany .

0420470 12/1934 United Kingdom ..... 452/82

*Primary Examiner*—Stephen C. Pellegrino
*Assistant Examiner*—Glenn Dawson
*Attorney, Agent, or Firm*—Fish & Richardson

[57] ABSTRACT

The invention is directed to an epilating appliance for the removal of human body hair, with a casing (1) adapted to be held in the user's hand, with a rotary cylinder (7) including pincer elements and driven by a motor (3), and with at least one actuator element (9, 10) extending through the rotary cylinder (7) for actuating the pincer elements (5, 6) coupled thereto, with at least one actuator element (9, 10) being operable by an associated pressure element (47) and being displaceable against the pressure of a spring (44), wherein the relative distance of cooperating pincer elements (5, 6) is variable by means of an adjusting device.

26 Claims, 6 Drawing Sheets

EPILATING APPLIANCE WITH GRIPPING FORCE ADJUSTMENT MEANS

This invention relates to an epilating appliance for the removal of human body hair, with a casing adapted to be held in the user's hand, with a rotary cylinder including pincer elements and driven by a motor, and with at least one actuator element extending through the rotary cylinder for actuating the pincer elements coupled thereto, with the actuator element being operable by an associated pressure element and being displaceable against the pressure of a spring.

An epilating appliance of the type initially referred to is known from EP 0 328 426 A2. The rotary cylinder which is adapted to be rotated by a rotary shaft is comprised of pivotally mounted pincer blades caused to perform pivotal movements by actuating rods extending through the rotary cylinder. In diametrically opposite arrangement on the shaft are two actuating-rod units producing gripping actions on each half revolution of the rotary cylinder. Each actuating-rod unit is comprised of two relatively associated actuating rods which are acted upon at their respective ends once per revolution by a respective roller rotatably mounted on a bar fixedly disposed in the epilation head, performing reciprocating movements in opposite directions against the pressure of a common spring. The relatively associated actuating rods transmit this movement to the pincer blades which pivot towards each other in pairs, being finally pressed into contact with each other in the area of their outer edges.

The two rollers .acting on the actuating rods are secured to the epilation head at a predetermined relative distance by means of a respective bar. Because reasons of manufacture do not allow this distance to be maintained accurately, the gripping force of the pincer blades at the gripping location is subject to considerable fluctuations. When the gripping force is too high, the relatively thin hairs are pinched off, and when it too weak, the hairs are not gripped sufficiently, preventing them from being extracted from the skin. An added disadvantage is the wear occurring on both the rollers and the actuating rods in the use of the epilating appliance due to friction and material fatigue, for example.

Another epilating appliance of the type initially referred to is known from EP 0 403 315 A1. The rotary cylinder of this epilating appliance is comprised of stationary pincer elements and pivotal pincer elements operatively associated therewith. The stationary pincer elements are a component part of a rotary shaft. Two diametrically opposed actuating rods extend through the rotary cylinder for the purpose of actuating the respective row of pincer elements. A roller rotatably mounted on a bar which is fixedly disposed in the epilation head acts upon each of the actuating rods once per revolution of the rotary cylinder either directly or indirectly through the intermediary of a specially configured pivot bearing, with the return stroke of the respective actuating rod being accomplished by means of a spring acting on it at its end remote from the roller.

It is an object of the present invention to improve the plucking of hair using an epilating appliance of the aforesaid type.

According to the present invention, this object is accomplished in an epilating appliance of the type set forth above in that the gripping force of cooperating pincer elements is variable by means of an adjusting device. The solution of the present invention finds useful application in a plurality of rotary cylinders of different configurations for epilating appliances.

In a preferred embodiment of the present invention, the pincer elements of the rotary cylinder are coupled to two relatively movable actuator elements, and the relative distance of the pincer elements of the first actuator element to the pincer elements of the second actuator element is variable by means of an adjusting device acting either directly or indirectly upon at least one of the actuator elements.

The variation of the relative distance of cooperating pincer elements through the relatively movable actuator elements by means of an adjusting device results in an increased gripping force of the cooperating pincer elements when the relative distance is diminished, and in a reduced gripping force when the relative distance is increased. An adjusting device that acts on the actuator elements of pincer elements directly or indirectly will accordingly ensure an optimum adjustment of the gripping force of cooperating pincer elements of an epilating appliance by the manufacturer who may compensate for manufacturing tolerances, for example, and also by the user who may adapt the gripping force to her individual requirements depending on the thickness of her hair and moreover, may correct a wear-related slackening of the gripping force by performing a readjustment.

In an embodiment of the present invention, the adjusting device is comprised of at least one spring determining the gripping force and of least one tightening element acting on the spring.

A preferred embodiment of the present invention is characterized in that a first one of the relatively movable actuator elements is fixedly connected with a drive shaft extending through the rotary cylinder, that the drive shaft is rotatably mounted in the casing, that a second actuator element is passed through the pincer elements of the first actuator element and is mounted on the first actuator element so as to be displaceable against the pressure of a spring acting on both actuator elements, and that the position of the second actuator element is variable, through a control element and a displaceably mounted pressure element, by a spring resting against the pressure element and at least one tightening element acting on the spring.

The spring which determines the gripping force of the pincer elements is preferably configured as a U-shaped spring.

An optimum adjustment of the gripping force of the pincer blades through the relatively movable actuator elements is accomplished by the spring of the adjusting device cooperating with two tightening elements acting on the spring, with one of the tightening elements being configured as an eccentric or polygonal rod adjustably mounted in the casing and having its surface(s) at different relative distances to the axis of rotation, and that the other tightening element is arranged as a stationary stop for the spring in the casing in the area between the pressure element and the tightening element.

In a further advantageous embodiment of the present invention, the second tightening element arranged in the area between the one tightening element and the pressure element is disposed in the casing as an adjustable stop for the spring, having its surface at different relative distances to its axis of rotation.

The advantage of this arrangement is particularly that following assembly of the epilating appliance all manufacturing tolerances can be compensated for by means of such an adjustable stop, whereby the adjusting device is provided with a defined basic setting, followed by an optimum fine adjustment by the operator using for this purpose the further tightening element acting on the spring and including an adjusting lever.

Preferably, the one side of the U-shaped spring bears against the pressure element and the tightening element, while the opposite side of the U-shaped spring bears against the tightening element. In order to accomplish an adjustment of the gripping force of cooperating pincer elements which affords ease of manipulation, an adjusting lever is provided on the tightening element.

The control element is preferably provided with a control curve having an elevation and a depression.

In a preferred embodiment of the present invention, a ball is mounted in the pressure element so as to roll therein.

In a particularly advantageous embodiment of the present invention, two stops are provided for the U-shaped spring on the wall of the bearing means. In a further aspect of this embodiment, one side of the U-shaped spring bears against the pressure element and against the two stops as well as against the tightening element, while the opposite side of the U-shaped spring bears against the stop. It is an essential advantage of such a configuration of the adjusting device that the U-shaped spring bearing against the two stops as well as against the tightening elements can be biased by turning the stop provided on the opposite side of the U-shaped spring. Utilizing this biasing force, a softer U-shaped spring, that is, a U-shaped spring with a shallow spring characteristic, can be employed in lieu of a hard U-shaped spring, in order to obtain the same desired gripping force of cooperating pincer elements. By comparison with a hard U-shaped spring having a steep spring characteristic, the use of a soft U-shaped spring having a shallow spring characteristic results in reduced fluctuations of the gripping forces occurring in the vicinity of the predetermined desired gripping force point, while the width of the manufacturing tolerance is maintained unchanged.

A further embodiment of the present invention is characterized in that in the open condition of the pincer elements a distance is provided between the ball and the depression in the control curve. On account of this distance, the pressure element equipped with a ball is not continuously, but only temporarily in abutment with the control curve of the control element during one revolution of the rotary cylinder. For one thing, this favors the adjustment of a bias of the U-shaped spring following assembly, serving for another thing for economy of operating energy.

In a further embodiment of the present invention, one of the relatively movable actuator elements is fixedly connected with a drive shaft extending through the rotary cylinder, and the drive shaft is mounted in the casing so as to be displaceable against the pressure of a spring bearing with one end against the tightening element and acting with its other end on the drive shaft.

In a further feature of this embodiment, the second actuator element associated with the first actuator element fixedly connected with the drive shaft is mounted so as to be displaceable against the pressure of a spring acting on both actuator elements, and the displaceable actuator element is adapted to be acted upon directly or indirectly by a pressure element fixedly arranged in the casing.

For actuation of the displaceable actuator element provided with pincer elements, a control element having a control curve is provided between the displaceable actuator element and the pressure element.

For the purpose of reducing friction between the pressure element and the actuator element or the control element, the pressure element is rotatably mounted on a bearing pin.

In a further feature of the last-mentioned embodiment, the drive shaft is arranged to extend through the tightening element and is rotatably and displaceably mounted therein, and the opposite end of the drive shaft projecting from the rotary cylinder is received in a second bearing means provided in the casing. The particular advantage of this embodiment is the utilization of existing components of the epilating appliance for integrating and controlling the components of the adjusting device as, for example, the utilization of one of the bearings of the drive shaft as a tightening element, the supporting function of the spring upon this bearing and upon an abutment integrally formed on the drive shaft, the displacement of the drive shaft within the two bearing means, as well as the use of the pressure element fixedly disposed within the casing for the actuating stroke of the displaceable actuator element carrying pincer elements, which stroke is variable by means of the adjusting device. In such a construction of the epilating appliance, the adjustment of the gripping force of cooperating pincer elements merely necessitates one additional component in the form of a spring resting with one end against the tightening element and acting with its other end upon the drive shaft.

A still further embodiment of the present invention is characterized in that an axle extending through the rotary cylinder is carried in two supporting elements in the housing of the epilation head, that a bearing element is rotatably mounted on the axle, that two relatively movable actuator elements are disposed on the bearing element in diametrically opposite arrangement so as to be displaceable against the pressure of a spring, that the actuator elements are operable through control elements by pressure elements carried in the supporting elements, and that at least one of the supporting elements is displaceably mounted on the axle and in the housing, with the relative distance of the supporting elements being variable by means of an adjusting device.

In a further feature of this embodiment, the adjusting device is comprised of at least one spring and a tightening element acting on the spring, in order to adjust the gripping force of the pincer elements to the desired value.

In a suitable feature of this embodiment, one of the supporting elements is fixedly disposed in the housing, and the opposite supporting element is displaceable on the axle by means of a spring arranged on the axle and by a tightening element acting on the spring. Preferably, the spring is a spring disk and the tightening element is an adjusting nut adapted to be screwed down on the axle. Further advantages and details of the present invention will become apparent from the subsequent description and the accompanying drawings illustrating some preferred embodiments.

In the drawings,

FIG. 1 is a sectional view of an epilating appliance with an adjusting device;

FIG. 1*a* is a sectional view of an epilating appliance showing the components of the adjusting device;

Figure 3:
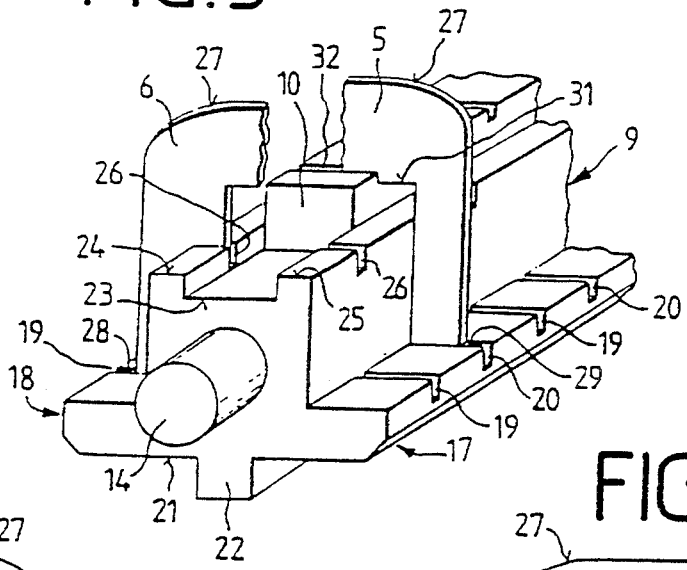
FIG. 3 is a perspective view of the actuator elements and the pincer elements of the rotary cylinder of FIG. 1.
Figure 3A:
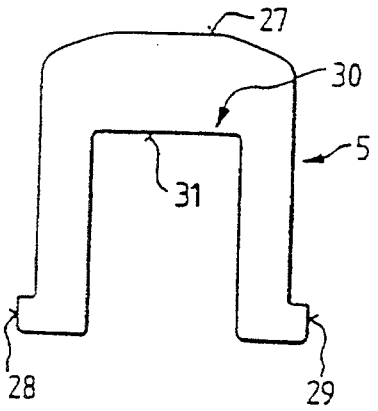
Figure 3B:
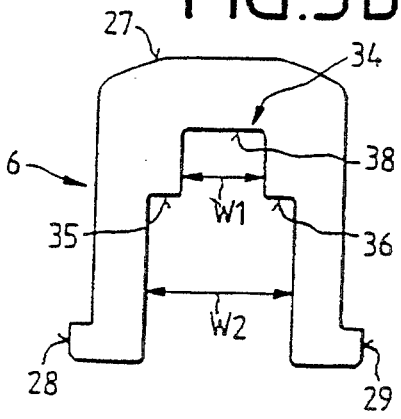
Figure 3C:
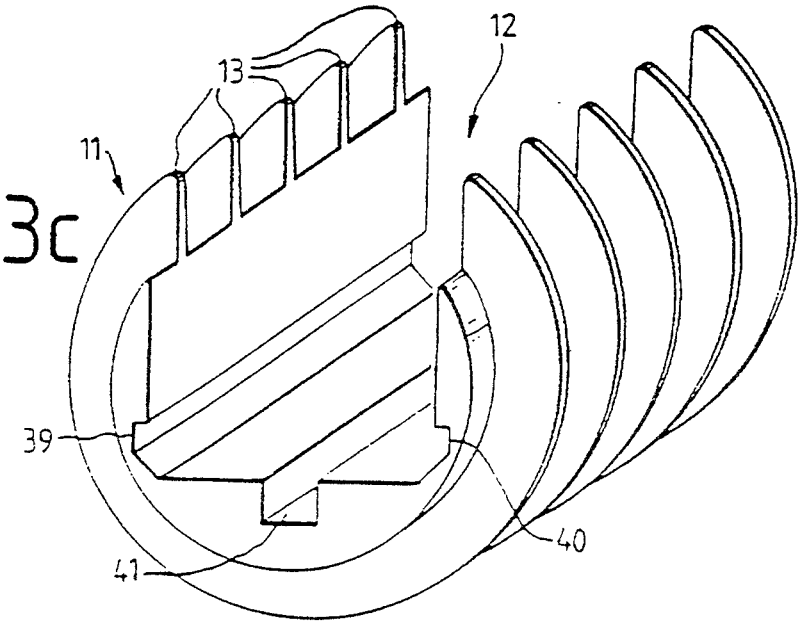
Figure 4:
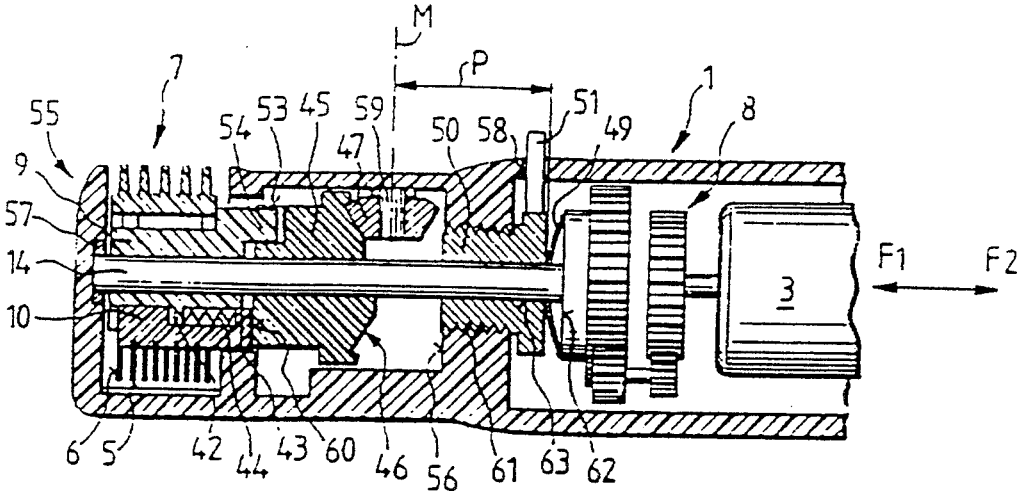
Figure 4A:
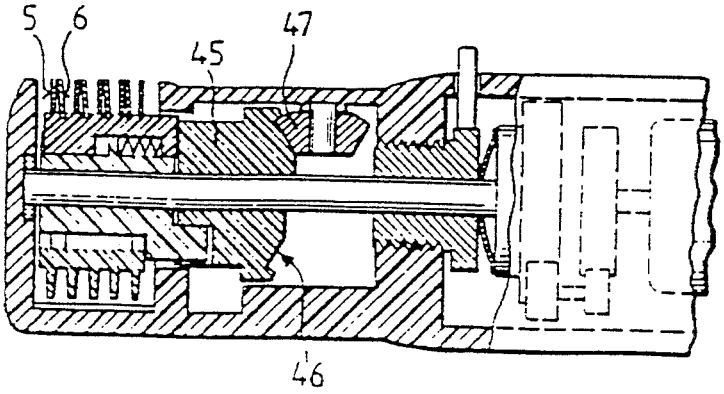
Figure 5:
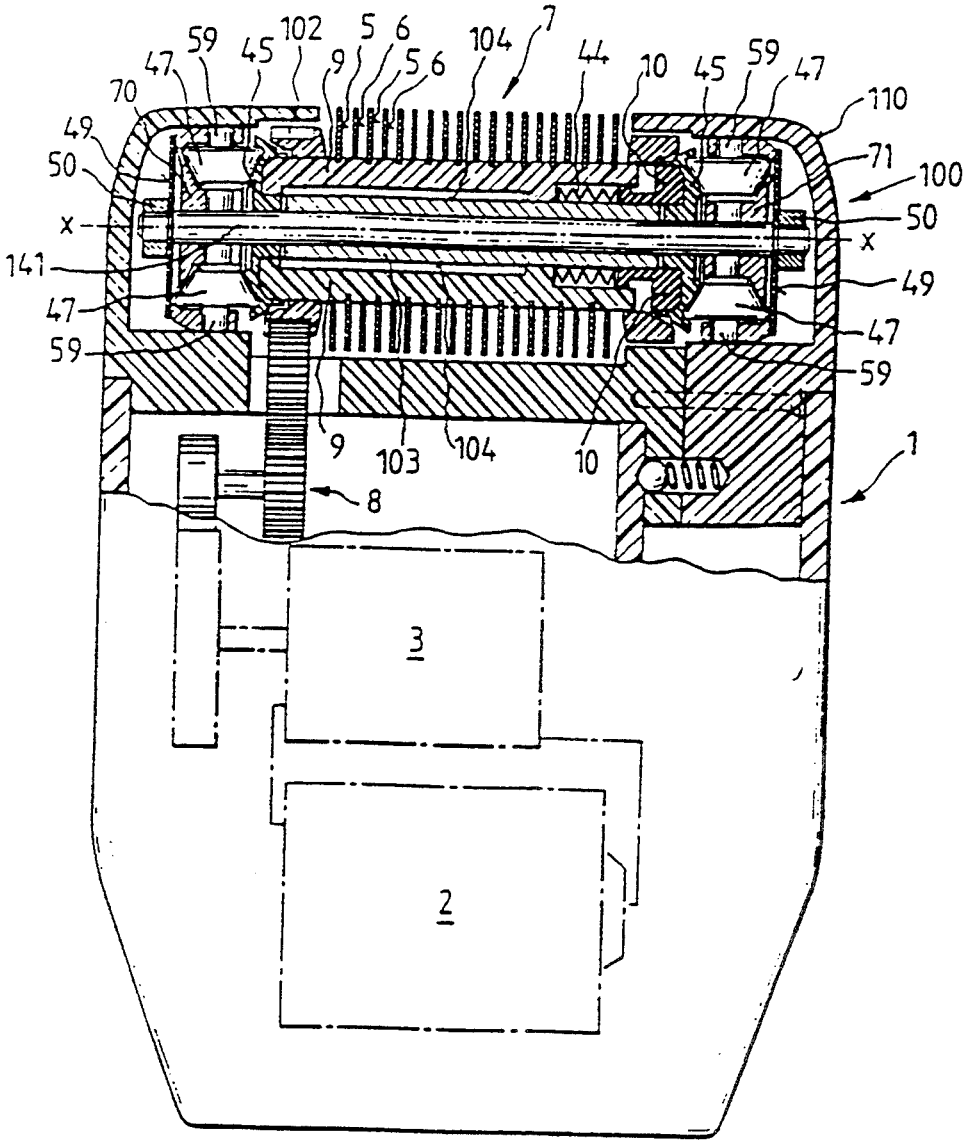
Figure 5A:
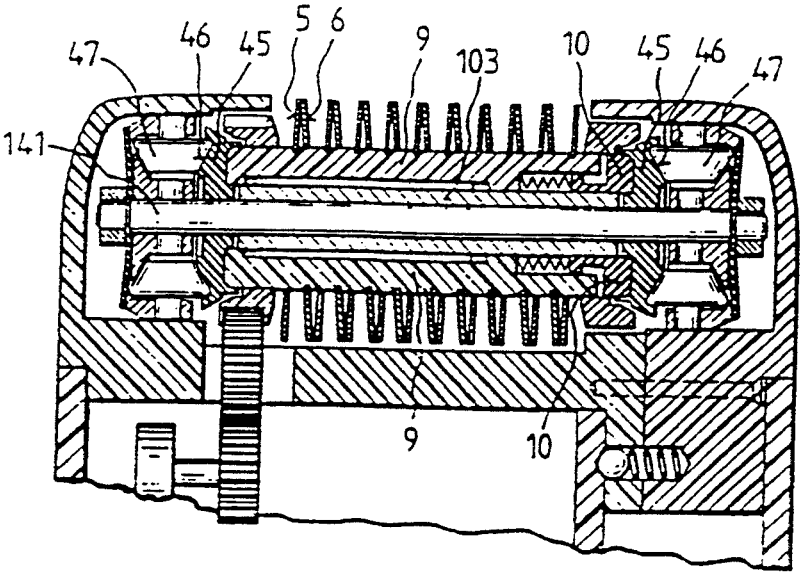
Figure 6:
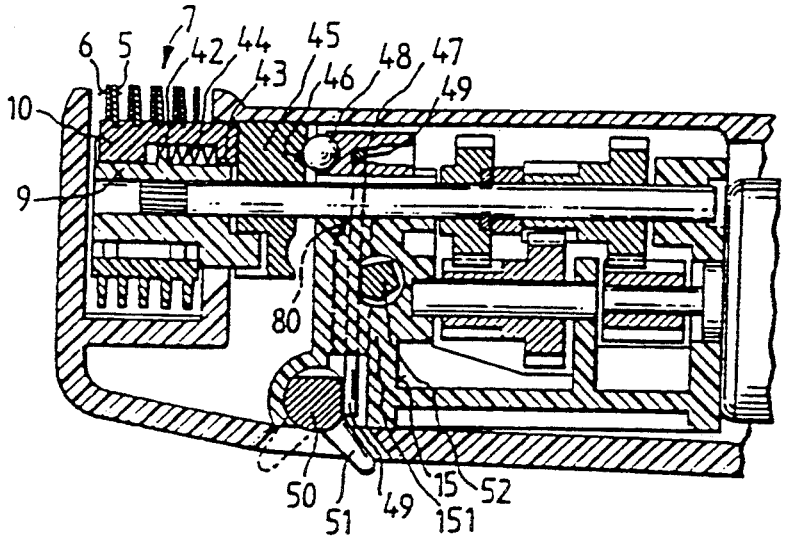

FIG. 3*a* is a view of a movable pincer element; FIG. 3*b* is a view of an immovable pincer element;

FIG. 3*c* is a perspective view of a comb structure;

FIG. 4 is a sectional view of an epilating appliance illustrating another embodiment thereof, incorporating an adjusting device and showing the pincer blades in the open condition;

FIG. 4*a* is a sectional view of the epilating appliance of FIG. 4, showing the pincer blades in the gripping position;

FIG. 5 is a sectional view of an epilating appliance illustrating a further embodiment thereof, incorporating an adjusting device disposed on an axle and showing the pincer blades in the open condition;

FIG. 5*a* is a sectional view of the epilating appliance of FIG. 5, showing the pincer blades in the gripping position;

FIG. 6 is a sectional view of an epilating appliance with an adjusting device; and FIGS. 7 to 10 are views of components of the adjusting device of FIG. 6.

Figure 1:
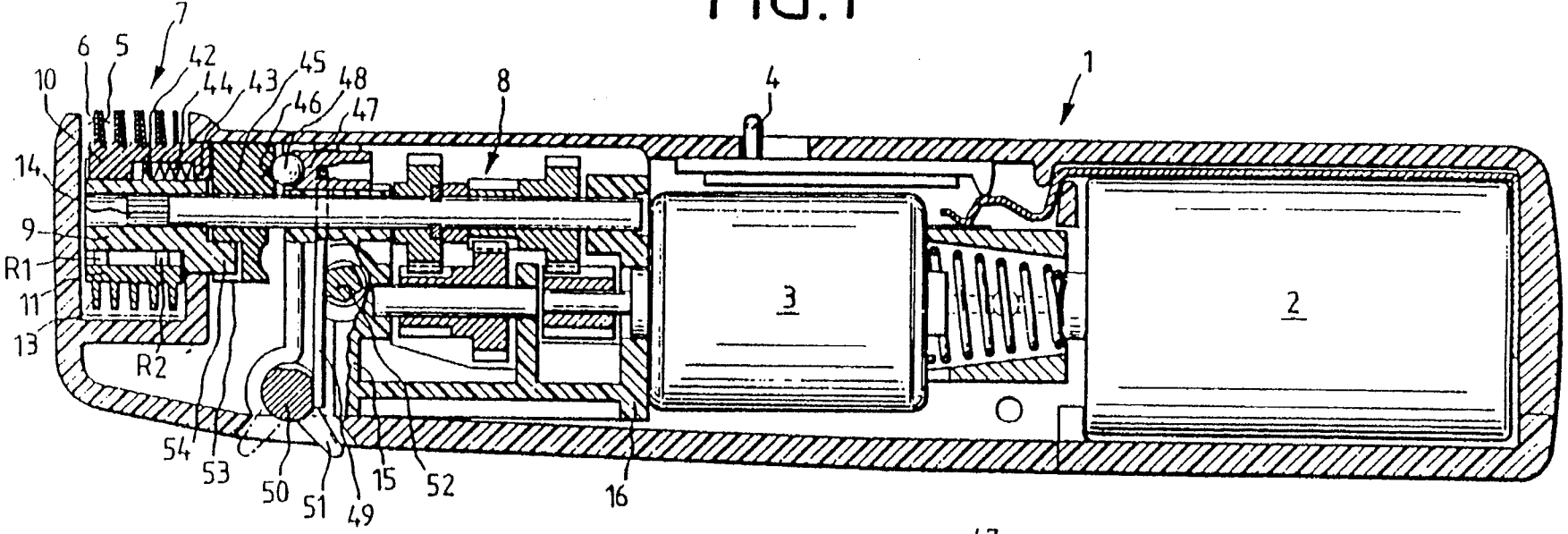
Figure 2:
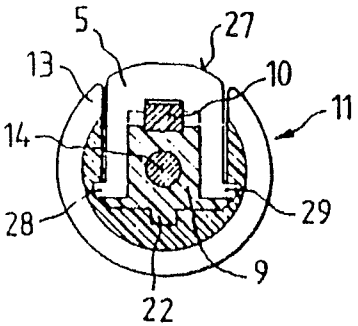
FIG. 2 is a sectional view of the rotary cylinder of an epilating appliance of FIG. 1.

FIG. 1 shows a section through the casing 1 of an epilating appliance in which electrical and mechanical drive elements are arranged, such as a storage cell 2, a motor 3, a switch 4 making and breaking the electrical connection between the storage cell 2 and the motor 3, a gear train 8, as well as a rotary cylinder 7 including pincer elements 5 and 6. The rotary cylinder 7 is comprised of two relatively movable actuator elements 9 and 10, the pincer elements 5 and 6 coupled to the actuator elements, and a cylindrical comb structure 11 including several comb teeth 13 and having a U-shaped recess 12 in which the actuator elements 9 and 10 carrying the pincer elements 5 and 6 are received—see FIGS. 2, 3 and 3*c*.

A rotary shaft 14 extending through the actuator element 9 is fixedly connected with the actuator element 9 and rotatably carried in two bearing means 15 and 16 provided in the casing 1. The gear train 8 comprising several gears is arranged between the bearing means 15 and 16 and is coupled to the rotary shaft 14 in a driving relationship thereto.

As becomes apparent from FIG. 3, the actuator element 9 includes two ledges 17 and 18 extending parallel to the center line of the rotary shaft 14 and providing several grooves 19, 20 for receiving the pincer elements 5 and 6. On the lower side wall 21 connecting the two opposed ledges 17 and 18, a further ledge 22 is provided for receiving and securing the comb structure 11. A U-shaped recess 23 is provided in the side wall of the actuator element 9 opposite the ledge 22, whereby ridges 24 and 25 are formed. Between the ridges 24 and 25 of the U-shaped recess 23, the actuator element 10 is mounted so as to be slidable parallel to the center line of the rotary shaft 14. The ridges 24, 25 are provided with several grooves 26 for receiving and securing the pincer elements 6.

As becomes apparent from FIGS. 2, 3, 3*a* and 3*b*, the pincer elements 5 and 6 are of a substantially rectangular configuration, having an arc-shaped outer side wall 27 whose curvature is essentially conformed to the circular shape of the rotary cylinder 7 or the comb teeth 13 of the comb structure 11. At the end opposite the side wall 27, the pincer ,elements 5 and 6 include outwardly directed arms 28 and 29. A U-shaped recess 30 is provided in the pincer element 5 of FIG. 3*a*. The depth of the recess 30 is dimensioned such that, following assembly of the arms 28 and 29 within the grooves 20 of the ledges 17 and 18 of the actuator element 9, the side wall 31 of the recess 30 will extend at a predetermined relative distance to the upper sides of the ridges 24, 25, in addition to being in engagement with the grooves 32 provided in the actuator element 10, as illustrated in FIG. 3. In this manner, all movable pincer elements 5 of the rotary cylinder 7 are coupled to the actuator element 10 by engagement within the grooves 32, while being pivotally mounted in the grooves 20 of the actuator element 9 by means of their arms 28 and 29.

The pincer element 6 of FIG. 3*b* includes two merging U-shaped recesses 34 of different widths $W_1$, $W_2$ for the purpose of providing fastening means 35, 36. In assembled condition, the pincer elements 6 have their arms 28, 29 rigidly secured within the grooves 19 of the ledges 17, 18, while their fastening means 35, 36 are rigidly secured within the grooves 26 provided in the ridges 24, 25. When assembled, the upper side wall 38 of the U-shaped recess 34 projects over the upper side wall of the actuator element 10 which is adapted to reciprocate within the actuator element 9 intermediate the ridges 24, 25 thereof.

The comb structure 11 comprising several comb teeth 13 includes within its. U-shaped recess 12 three outwardly extending recesses 39, 40, 41. The dimensions and contours of the recesses 12, 39, 40 and 41 are conformed to the outer contour of a subassembly composed of the actuator elements 9, 10 and the pincer elements 5, 6—see FIG. 3—, so that following mounting of the comb structure 11 on this subassembly, an enclosed rotary cylinder is formed as becomes apparent, for example, from FIG. 2. By partially embracing the ledges 17 and 18, the upper side walls of the recesses 39, 40 prevent the lateral arms 28 and 29 of the pincer elements 5, 6 from becoming disengaged from their respective grooves 19, 20. On the ledge 22 of the actuator element 9 and in the recess 41 of the comb structure 11, interengaging detent means $R_1$, $R_2$ are provided for the purpose of coupling these components together—see FIG. 1.

As becomes apparent from FIG. 1, a spring 44 is provided between a stop 42 disposed on the actuator element 9 and a stop 43 formed on the actuator element 10, the spring serving to move the relatively movable actuator elements 9, 10, and consequently the pincer elements 5, 6 coupled thereto, from a gripping position into an open position, in dependence upon the position of the control element 45 acting on the slidable actuator element 10.

The control element 45 is slidably mounted on the rotary shaft 14 and is provided with a coulisse 53 which extends parallel to the rotary shaft 17 and is engaged by a coupling element 54 arranged on the actuator element 9 for the purpose of transmitting the rotary motion. At its end remote from the actuator element 10, the control element 45 is provided with a control curve 46 which, in combination with a pressure element 47 arranged in the casing 1 and through the intermediary of a ball 48 reducing the friction between the pressure element 47 and the control curve 46, shifts the actuator element 10 in opposition to the pressure of the spring 44.

The pressure element 47 is slidably mounted in the casing 1 and is acted upon by a spring 49 having its opposite end resting against a tightening element 50.

Figure 1A:
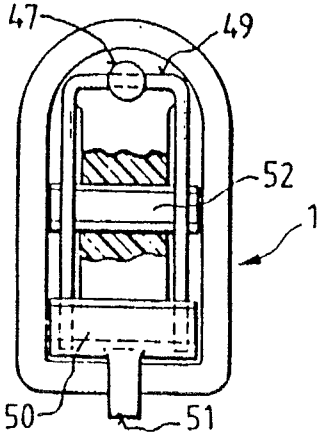

The tightening element 50 is rotatably mounted in the casing 1 and provided with an adjusting lever 51 projecting from the casing 1. The spring 49 which is preferably configured as a U-shaped spring—see FIG. 1*a*—rests with its portion remote from the tightening element 50 and the pressure element 47 against a stop 52 in the wall 151 of the bearing means 15, the stop being disposed in the casing 1 in the .area between the pressure element 47 and the tightening element 50. The tightening element 50 may be configured as an eccentric or, as illustrated in FIG. 1, as a polygonal rod whose respective side surfaces are at different relative distances to its axis of rotation, in order to effect an adjusting stroke on the abutting spring 49. The stop 52 may be a fixed stop or, as shown, it may be rotatably arranged in the casing 1 as an adjustable polygonal rod having its respective side surfaces at different relative distances to its axis of rotation, in order to provide the adjusting device with a basic setting, for example, to compensate for manufacturing tolerances following assembly of the appliance.

By virtue of this additional means, the adjusting range provided for the tightening element 50 can be used to its full extent for fine adjustment of the gripping force of the pincer elements 5 and 6 cooperating in pairs.

The epilating appliance of FIGS. 4 and 4*a* shows a rotary cylinder 7 arranged on the rotary shaft 14 and configured in accordance with the rotary cylinder described with reference to FIGS. 1 to 3*c*. The actuator element 9 of the rotary cylinder 7 is fixedly coupled to the rotary shaft 14 for the purpose of transmitting the rotary motion. The rotary shaft 14 has its one end rotatably carried in a bearing means 57 disposed in the end 55 of the casing 1, while its other end is rotatably carried in a wall 56 of the casing 1, with the latter bearing means being formed by a tightening element 50 surrounding the rotary shaft 14 and being in threaded engagement with the wall 56.

The tightening element 50 is provided with an adjusting lever 51 projecting from an opening 58 in the casing 1.

A pressure element 47 of a conical configuration is rotatably mounted on a bearing pin 59 fixedly disposed on the casing 1. Arranged between the pressure element 47 and the actuator elements 9 and 10 is a control element 45 slidably mounted on the rotary shaft 14, its control curve 46 resting against the outer surface of the pressure element 47, while its end 60 acts only upon the actuator element 10. The rotary motion of the rotary shaft 14 is transmitted through the actuator element 9 to the control element 45.

To this end, the control element 45 includes a coulisse 53 extending parallel to the axis of the rotary shaft 14 and engaged by a coupling element 54 provided on the actuator element 9. The lengths of the coulisse 53 and the coupling element 54 engaging therein are coordinated such that the control element 45 slidably mounted on the rotary shaft 14 is able to execute the actuating stroke predetermined by the control curve 46, and the adjusting stroke effected by means of the adjusting device.

The adjusting device is composed of the tightening element 50 screw connected to the wall 56 by means of a thread 61 and having the rotary shaft 14 extending therethrough for the purpose of being coupled to a gear train 8 adapted to be driven by a motor 3, of a stop 62 provided on the rotary shaft, and of a spring 49 disposed between the opposed ends of the tightening element 50 and the stop 62, the spring being configured as an elastic or flexible cup spring, for example.

Depending on the direction in which the adjusting lever 51 is turned to rotate the tightening element 50 in its thread 61, the position of the tightening element 50 in the wall 56 relative to the pressure element 47 fixedly disposed in the casing 1 by means of the bearing pin 59 is varied in the direction of either arrow $F_1$ or $F_2$. Each variation of the relative distance P of the tightening element 50 to the center line M of the pressure element 47 is transmitted through the spring 49 and the stop 62 to the rotary shaft 14, effecting a displacement of the rotary shaft 14 within its bearing means 57 and 63 in the direction of either arrow $F_1$ or $F_2$, as well as producing a variation of the relative positions of the actuator elements 9 and 10 of the rotary cylinder to the center line M of the fixedly disposed pressure element 47.

On account of the fixed coupling of the actuator element 9 to the rotary shaft 14, the variation of the position of the rotary shaft 14 is transmitted to the actuator element 10 through the spring 44 resting with one end against the stop 42 of the actuator element 9 and with its other end against the stop 43 of the actuator element 10, until the tension forces of the springs 44 and 49 are balanced. In this manner, the relative distance of the relatively movable actuator elements 9 and 10 to the pincer elements 5 and 6 coupled thereto is variable through the adjusting device shown and described, in consequence of which the gripping effect of the pincer elements 5 and 6 cooperating in pairs is adjustable to a desired degree.

FIG. 4 shows the pincer elements 5 and 6 of the epilating appliance in the open position. In this position, the pressure element 47 is in a depression provided in the control curve 46 of the control element 45. As the control curve 46 is rotated through 180 degrees, an elevation in this curve will come to rest against the pressure element 47, causing a displacement of the actuator element 10 with, its pincer blades 5 against the pressure of the spring 44 and moving the pincer blades 5 into engagement with the pincer blades 6 coupled to the actuator element 9, as illustrated in FIG. 4*a*.

FIG. 5 is a sectional view of an epilating appliance, showing the pincer elements 5 and 6 in the open condition and comprising electrical and mechanical drive elements as, for example, a casing 1 accommodating a storage cell 2, a motor 3 and a gear train 8, and an epilation head 100 detachably disposed on the casing 1. Provided in the housing 110 of the epilation head 100 is a rotary cylinder 7 formed by several pincer elements 5, 6 and rotated by means of a gear 102 of the gear train 8. The pincer elements 5, 6 are coupled to actuator elements 9, 10 which extend through the rotary cylinder 7 and are arranged on a bearing element 103 rotatably mounted on the axle 141 so the are displaceable parallel to the center line x-x against the pressure of a spring 44. The actuator elements 9, 10 and the common spring 44 acting thereon combine to form a unit of actuator elements. A second unit of actuator elements is horizontally movably mounted on the bearing element 103 in diametrically opposite arrangement to the first unit of actuator elements. The gear 102 rotating the rotary cylinder 7 is coupled to the bearing element 103 in a driving relationship thereto.

At either end of the rotary cylinder 7, there are provided a control element 45 rotatable and displaceable on the axle 141 and at least one pressure element 47 acting on the associated control element 45. In the embodiment illustrated in FIG. 5, the respective pressure element 47 is associated with a further pressure element 47 in diametrically opposite arrangement. The pressure elements 47 are of a frusto-conical configuration, each being rotatably mounted on a bearing pin 59.

The housing 110 of the epilation head 100 accommodates two supporting elements 70, 71 in which the axle 141 is carried and the bearing pins 59 are fastened. At either end of the axle 141, a spring 49 and a tightening element 50 are provided by means of which the relative distance of the supporting elements 70, 71 acted upon by the spring 49 and, in consequence, the relative distance of the pressure elements 47 is adjustable by exerting a pressure on the springs 49. To accomplish this, it is necessary that at least one of the supporting elements 70, 71 be displaceably mounted in the housing 110 of the epilation head 100. The springs 49 are preferably configured as cup springs and the tightening elements 50 as threaded nuts adjustably screwed into the threads provided at either end of the axle 141.

Any variation of the relative distance of the pressure elements 47 through their respective supporting elements 70, 71 is transmitted via the control elements 45 to the actuator elements 9, 10 extending through the rotary cylinder 7, consequently varying the relative distance of the actuator elements 9, 10 of the respective unit of actuator elements displaceable relative to each other against the pressure of the spring 44 and carrying the pincer elements 5, 6.

The relative distance of the pincer elements 5 and 6 arranged on the actuator elements 9, 10 and cooperating through these in pairs determines the gripping force occurring. This distance and thus the gripping force occurring on the pincer blades 5 and 6 is variable by turning at least one of the threaded nuts 50, with a very fine adjustment of the gripping force being ensured by taking into account the elastic deformability of the cup springs 49. In the embodiment illustrated in FIG. 5, a reduction of the relative distance of the pincer blades 5, 6 to the diametrically opposed pressure elements 47 results in an increased gripping force, whereas an increase in this distance results in a reduced gripping force of the operatively associated pincer elements 5, 6.

The epilating appliance of FIG. 5 and FIG. 5*a* includes a rotary cylinder 7 having two units of actuator elements extending through the rotary cylinder 7, of which one will be described in more detail in the following. The actuator elements 9 and 10 are arranged on the sliding surface 104 of a square bearing element 103 so as to be slidable parallel to the center line x-x of the axle 141, The actuator elements 9, 10 arranged adjacent to each other or in an interengaging fashion are provided with slots in which the pincer elements 5 and 6 are fixed and pivotally mounted in alternating sequence. The pincer elements 5 forming a row of pincer elements are coupled to the actuating element or rod 9, while the pincer elements 6 forming a further row of pincer elements are coupled to the actuating element or rod 10. The actuating rods 9 and 10 are displaceable relative to each other against the pressure of a spring 44, whereby a sliding action caused by the pressure elements 47 through the control elements 45 in relatively opposed directions results in the row of pincer elements 5 being urged into contact with the row of pincer elements 6, as illustrated in FIG. 5*a*. Subsequent to the gripping action, as the rotary cylinder 7 continues rotating, the pincer elements 5, 6 will be moved into an open position by the tensioned spring 44 urging the actuator elements 9, 10 apart, as shown in FIG. 5.

In FIGS. 5 and 5*a*, the pressure elements 47 are of frusto-conical shape in order to enable the pressure elements 47 to roll continuously along the inclined surface of the control curve 46 of the control elements 45 conformed to the pressure elements. The length of the stroke necessary for the displaceability of the actuator elements 9, 10 is determined by means of cams integrally formed in the control curve 46 of the control elements 45, as becomes apparent from FIGS. 5 and 5*a*.

In FIGS. 5 and 5*a*, the epilating appliance is equipped with two units of actuator elements provided with pincer elements 5 and 6, as described previously, in order to enable the pincer elements 5 and 6 to perform two gripping actions per revolution of the rotary cylinder 7. By contrast, the rotary cylinder 7 may also be equipped with only one unit of actuator elements performing only one gripping action, or alternatively, with more than two units of actuator elements for performing several gripping actions per revolution.

FIG. 6 is a view of the embodiment of FIG. 1, yet differing in that two stops 80 are provided on the wall 151 of the bearing means 15 for a spring 49 configured as a U-shaped spring. The section being made through the wall 151, only one stop 80 is shown in the representation of FIG. 6. The stops 80 are preferably provided on the outer, vertically extending sides of the wall 151. With the pincer elements 5 and 6 in the open condition, the side of the U-shaped spring 49 close to the rotary cylinder 7 rests with its vertically extending legs against the two stops 80 and the tightening element 50, while the spring portion connecting the legs and extending transversely to the axis of the rotary shaft 14 rests against the pressure element 47. The side of the U-shaped spring 49 remote from the rotary cylinder has both its legs in abutment with the stop 52. Details of this abutting engagement of the U-shaped spring 49 with the pressure element 47, the stops 80 and 52 and the tightening element are illustrated schematically in FIGS. 7 and 8, 9 and 10 and will be described in greater detail in the following.

Figure 7:
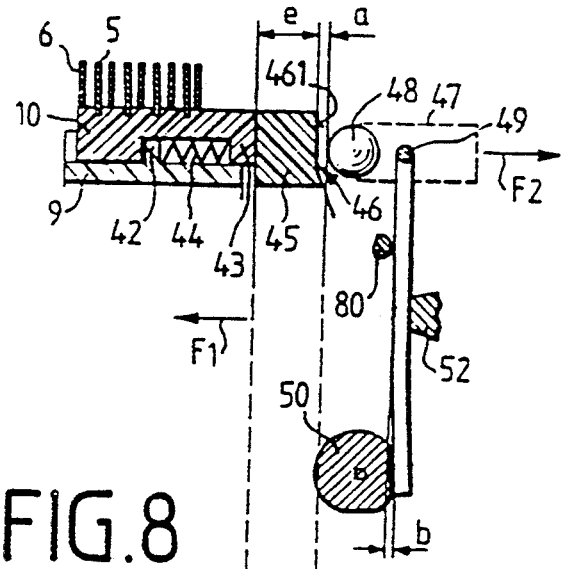

FIG. 7 shows the actuator element 10 provided with the pincer elements 5 and being displaceable towards the pincer elements 6 coupled to the actuator element 9 against the pressure of the untensioned spring 44. Between the actuator element 10 and the pressure element 47 in which a ball 48 is received so as to roll therein, a control element 45 having a control curve 46 is provided. The control curve 46, for example, is of an undulating configuration, producing a depression 461 of a thickness e and an elevation 462 of a thickness e'.

Following its assembly, the spring 49 will rest with one side against the pressure element 47, the stops 80 and the tightening element 50, and against the stop 52 with its other side. By turning the stop 52 which is configured, for example, as a polygonal rod, the U-shaped spring 49 resting against the stops 80 and the tightening element 50 is provided with a basic setting which, among other functions, compensates for manufacturing tolerances and may include both a tension-free abutting engagement of the U-shaped spring with the stops 80, the tightening element 50 and the stop 52, and a small bias of the U-shaped spring 49 produced by the stop 52. The adjustment of the gripping action of the pincer elements 5 and 6 cooperating in pairs is made following the assembly of the epilating appliance by the user adjusting the tightening element 50 by turning the adjusting lever 51. In FIG. 7, for example, the bias of the U-shaped spring produced by the stop 52 is adjusted such as to be proportional to the distance b on the tightening element 50. Assuming this basic setting, the ball 48 of the pressure element 47 is at a small relative distance a to the depression 461 in the control curve 46 of the control element 45, abutting in the course of rotation of the control element 45 with the control curve 46, in dependence on the magnitude of the distance a and the gradient of the control curve 46 from the depression 461 to the elevation 462. Following abutment of the ball 48 with the control curve 46, with the rotation of the control element 45 continuing, the gradient of the control curve 46 will cause a displacement of the control element 45 on the rotary shaft 14 in the direction of arrow $F_1$ by an amount corresponding to the actuating stroke c, in addition to causing a movement of the pressure element 47 with the ball 48 in the direction of arrow $F_2$ by an amount corresponding to the spring excursion d. The control element 45 thus displaces the abutting actuator element 10 equipped with pincer elements 5 in the direction of arrow $F_1$ against the pressure of the spring 44 by an amount corresponding to the actuating stroke c, displacing at the same time the pressure element 47 equipped with the ball 48 and the U-shaped spring 49 in the direction of arrow $F_2$ by an amount corresponding to the spring excursion d, with the U-shaped spring which rests against the stops 80 then disengaging from the stops 80 by moving in the direction of arrow $F_2$.

Figure 8:
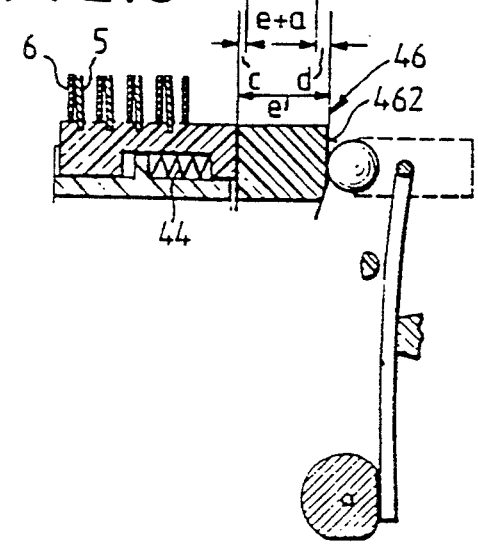
Figure 9:
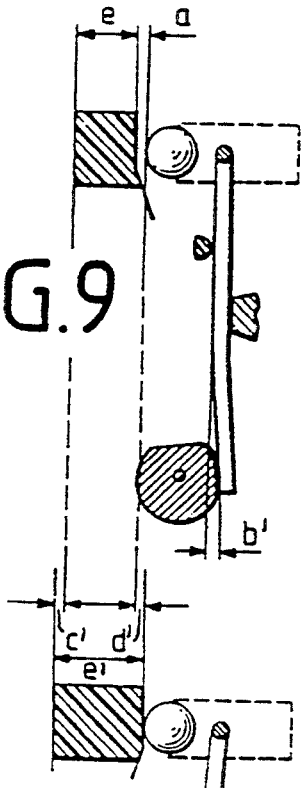
Figure 10:
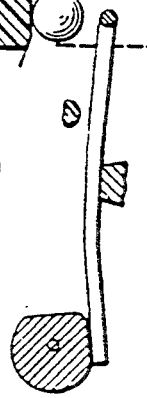

The gripping force of the pincer elements 5 and 6 cooperating in pairs and illustrated in FIG. 8 is dependent on the spring force of the U-shaped spring 49 subsequent to its disengagement from the stops 80 in the direction of arrow $F_2$ under the action of the thickness e' of the elevation 462 in the control curve 46 and the tension force of the spring 44 acting in opposition to its tension force in the direction of arrow $F_1$.

The spring force of the U-shaped spring 49 resting against the stops 80 and 52 and against the tightening element 50 is variable by means of the surfaces of the polygonal rod of the tightening element 50 and/or the surfaces of the polygonal rod of the stop 52. Assuming the setting shown in FIG. 7, the spring force of the U-shaped spring 49 can be increased in the direction of arrow $F_2$ by the adjusting stroke b' by turning the tightening element 50 resulting in abutting engagement of another surface of the polygonal rod with the U-shaped spring 49—see FIG. 9. As a result, the bias of the U-shaped spring 49 will increase in accordance with the increase from b to b' whereby in operation of the epilating appliance, following disengagement of the U-shaped spring 49 the actuating stroke will be increased from c to c' and the spring excursion will be reduced from d to d' in accordance with the compensation of the spring tension occurring between the springs 44 and 49. Accordingly, a continuous or stepwise increase in the bias of the U-shaped spring 49 by means of the tightening element 50 and/or the stop 52 causes an increased gripping force of the pincer elements 5 and 6, whereas a reduced bias of the U-shaped spring 49 results in a reduced gripping force. The gripping action of cooperating pincer elements 5 and 6 may be further improved in combination with the variation of the gripping force in that at least one of the pincer elements 5 or 6 cooperating in pairs is of an elastic configuration. By this means, cooperating gripping surfaces of a pair of pincers are increased, preventing trapped hair from being pinched off.

We claim:

1. An epilating appliance for the removal of human body hair comprising casing structure adapted to be held in the user's hand, a motor and rotary cylinder structure carried by said casing structure, said rotary cylinder structure being driven by said motor and including a plurality of pincer elements disposed in cooperating pairs that are adapted to provide gripping forces therebetween, at least one actuator element extending through said rotary cylinder structure and coupled to said pincer elements for actuating said pincer elements, structure for operatively moving said one actuator element to actuate said pincer elements, biasing structure, said at least one actuator element being displaceable against the pressure of said biasing structure, and adjusting device structure acting upon said at least one actuator element for varying the gripping force between a pair of cooperating pincer elements.

2. The epilating appliance of claim 1 wherein said appliance includes two of said actuator elements that are movable relative to one another, a first group of said pincer elements of said rotary cylinder structure being coupled to one of said two actuator elements, a second group of said pincer elements of said rotary cylinder structure being coupled to the other of said two actuator elements, the distance of said pincer elements of said first group relative to the pincer elements of said second group being variable by means of said adjusting device structure acting upon at least one of said actuator elements.

3. The epilating appliance of claim 2 and further including a drive shaft extending through said rotary cylinder structure and rotatably mounted in said casing structure, control structure, a spring member, a displaceably mounted pressure element and tightening structure, and wherein a first one of said relatively movable actuator elements is fixedly connected with said drive shaft, a second actuator element is passed through said pincer elements of one of said groups and is mounted on said first actuator element so as to be displaceable against the pressure of said spring member acting on both of said actuator elements, the position of said second actuator element relative to said first actuator element being variable, through said control structure and said displaceably mounted pressure element, by said biasing structure resting against said displaceably mounted pressure element and said tightening structure acting on said biasing structure.

4. The epilating appliance of claim 3 wherein said biasing structure is configured as a U-shaped spring.

5. The epilating appliance of claim 4 wherein one side of said U-shaped spring bears against said pressure element and said tightening structure, while an opposite side of said U-shaped spring bears against a stop.

6. The epilating appliance of claim 4 and further including bearing structure for supporting said drive shaft and first stop structure for said U-shaped spring disposed on said bearing structure.

7. The epilating appliance of claim 6 and further including second stop structure and wherein one side of said U-shaped spring bears against said pressure element and against said first stop structure as well as against said tightening structure, while the opposite side of said U-shaped spring bears against said second stop structure.

8. The epilating appliance of claim 7 and further including a ball mounted in said pressure element so as to roll therein and wherein said control structure is provided with a control curve having an elevation and a depression such that, in the open condition of said pincer elements, a distance (a) is provided between said ball and said depression in said control curve.

9. The epilating appliance of claim 3 wherein said tightening structure is a rod member that is rotatably mounted in said casing structure, said rod member having surface portions at different relative distances to its axis of rotation.

10. The epilating appliance of claim 3 and further including stationary stop structure for said biasing structure disposed in said casing structure in the area between said pressure element and said tightening structure.

11. The epilating appliance of claim 3 and further including a fixed support and adjustable stop structure for said biasing structure disposed in said casing structure in the area between said pressure element and said tightening structure, said adjustable stop structure having a surface and being movable relative to said fixed support so that its surface may be positioned at different distances relative to said fixed support.

12. The epilating appliance of claim 3 wherein said control structure is provided with a control curve having an elevation and a depression.

13. The epilating appliance of claim 3 and further including a ball mounted in said pressure element so as to roll therein.

14. The epilating appliance of claim 3 wherein one of said relatively movable actuator elements is fixedly connected with said drive shaft, and said drive shaft is mounted in the casing structure so as to be displaceable against the pressure of said biasing structure, one end of said biasing structure bearing against said tightening structure and the other end of said biasing structure acting on said drive shaft.

15. The epilating appliance of claim 14 and further including pressure structure fixedly arranged in said casing, and wherein said second actuator element is mounted so as to be displaceable against the pressure of said spring member, and said displaceable actuator element is adapted to be acted upon by said fixedly arranged pressure structure.

16. The epilating appliance of claim 15 wherein said control structure has a control curve and is disposed between said displaceable actuator element and said pressure structure.

17. The epilating appliance of claim 15 wherein said pressure structure includes a rotatably mounted member.

18. The epilating appliance of claim 15 wherein said drive shaft extends through said tightening structure and is rotatably and displaceably mounted therein, and that an end of said drive shaft projects from said rotary cylinder structure and is received in bearing structure provided in said casing structure.

19. The epilating appliance of claim 15 wherein said tightening structure is adjustably arranged in a wall of said casing structure by means of a screw connection.

20. The epilating appliance of claim 1 wherein said adjusting device structure is comprised of spring structure and least one tightening element acting on said spring structure.

21. The epilating appliance of claim 20 and further including adjusting lever structure attached to said at least one tightening element.

22. The epilating appliance of claim 1 and further including two support elements in said casing structure and an axle extending through said[rotary cylinder structure and carried in said support elements, a bearing element rotatably mounted on said axle, said at least one actuator element includes two relatively movable actuator elements being disposed on said bearing element in a diametrically opposite arrangement so as to be displaceable against the pressure of spring structure, said actuator elements are operable through control elements by pressure elements carried in said support elements, and at least one of said support elements is displaceably mounted on said axle and in said casing structure, with the relative distance of said support elements being variable by means of said adjusting device structure.

23. The epilating appliance of claim 22 wherein said adjusting device structure includes at least one spring and a tightening element acting on said spring.

24. The epilating appliance of claim 22 wherein one of said support elements is fixedly disposed in said casing structure, and the other said support element is displaceable on said axle by means of a spring arranged on said axle and by a tightening element acting on said spring.

25. The epilating appliance of claim 21 wherein said spring is a spring disk and said tightening element is an adjusting nut adapted to be screwed down on said axle.

26. The epilating appliance of claim 25 wherein said tightening element is provided with an adjusting lever.

* * * * *

UNITED STATES PATENT AND TRADEMARK OFFICE

CERTIFICATE OF CORRECTION

PATENT NO. : 5,441,506

DATED : August 15, 1995

INVENTOR(S) : Gabion, et al.

It is certified that error appears in the above-identified patent and that said Letters Patent is hereby corrected as shown below:

Title page, item [75] Inventors: replace "Clevet" with —Cleyet—.

Col. 1, line 33, replace ".acting" with --acting--

Col. 5, line 5, after "element," begin a new pararaph

Col. 5, line 68, replace ",elements" with —elements—.

Col. 6, line 28, replace "its." with --its--

Col. 8, line 39, replace "with," with --with--

Col. 11, line 51, replace "whereby" with --, whereby,--

Col. 11, line 55 replace "c′" with --c′,--

Col. 14, claim 22, line 24, replace "said[rotary" with --said rotary--

Col. 14, claim 22, line 30, after "of" insert --said--

UNITED STATES PATENT AND TRADEMARK OFFICE

CERTIFICATE OF CORRECTION

PATENT NO. : 5,441,506

DATED : August 15, 1995

INVENTOR(S) : Gabion, et al.

It is certified that error appears in the above-indentified patent and that said Letters Patent is hereby corrected as shown below:

Col. 14, claim 25, line 46, replace "21" with —24—

Signed and Sealed this

Twenty-seventh Day of August, 1996

*Attest:*

BRUCE LEHMAN

*Attesting Officer*

*Commissioner of Patents and Trademarks*